United States Patent [19]

Perrucchini

[11] Patent Number: 4,779,403

[45] Date of Patent: Oct. 25, 1988

[54] BAG INSERTING DEVICE FOR AUTOMATIC BAG LOADING APPARATUS OF ROTARY BAGGING MACHINES

[75] Inventor: Vincenzo Perrucchini, Brembate Sopra, Italy

[73] Assignee: Car-Ventomatic S.p.A., Bergamo, Italy

[21] Appl. No.: 113,827

[22] Filed: Oct. 29, 1987

[30] Foreign Application Priority Data

Oct. 30, 1986 [IT] Italy ..... 22191 A/86

[51] Int. Cl.[4] ..... B65B 43/16

[52] U.S. Cl. ..... 53/573; 53/251; 141/154; 141/167

[58] Field of Search ..... 53/251, 573; 141/154, 141/166, 167, 114, 68, 270, 271, 283

[56] References Cited

U.S. PATENT DOCUMENTS 3,462,917 8/1969 Nakashima ..... 53/571 X 4,648,234 3/1987 Bellini ..... 141/166 X

FOREIGN PATENT DOCUMENTS 2627304 12/1977 Fed. Rep. of Germany ..... 141/166

*Primary Examiner*—John Sipos

*Attorney, Agent, or Firm*—McAulay, Fields, Fisher, Goldstein & Nissen

[57] ABSTRACT

The invention discloses a novel type of bag threading device to be used in an automatic bag loading apparatus for rotary bagging machines, and substantially comprises a stationary vertical support frame (10) holding a swinging arm (12) bearing at the other end the pincers (13) associated with a system of connecting rod (14) and crank (19) having the function of rotating the pincers (13) in order to position them in the picking phase axially aligned with the bag (3) to be picked and subsequently with the nozzle (2) of the bagging machine, said arm being able to carry out an angular displacement between to bag positioning device (6) and the nozzle (2) of the rotary bagging machine (1) to be fed in that moment, effected by a cam (15) in order to carry out its angular displacement, acting on a roller (17) arranged on said swinging arm (12), the cam (15) being rotated around its shaft by a motor with reduction unit, the cam shaft and that of the bagging machine being rotated in a synchronous way through known means such as frequence variators and the like.

4 Claims, 2 Drawing Sheets

BAG INSERTING DEVICE FOR AUTOMATIC BAG LOADING APPARATUS OF ROTARY BAGGING MACHINES

The present invention relates to a bag inserting device to be used on automatic bag loading apparatus of rotary bagging machines.

Figure 1:
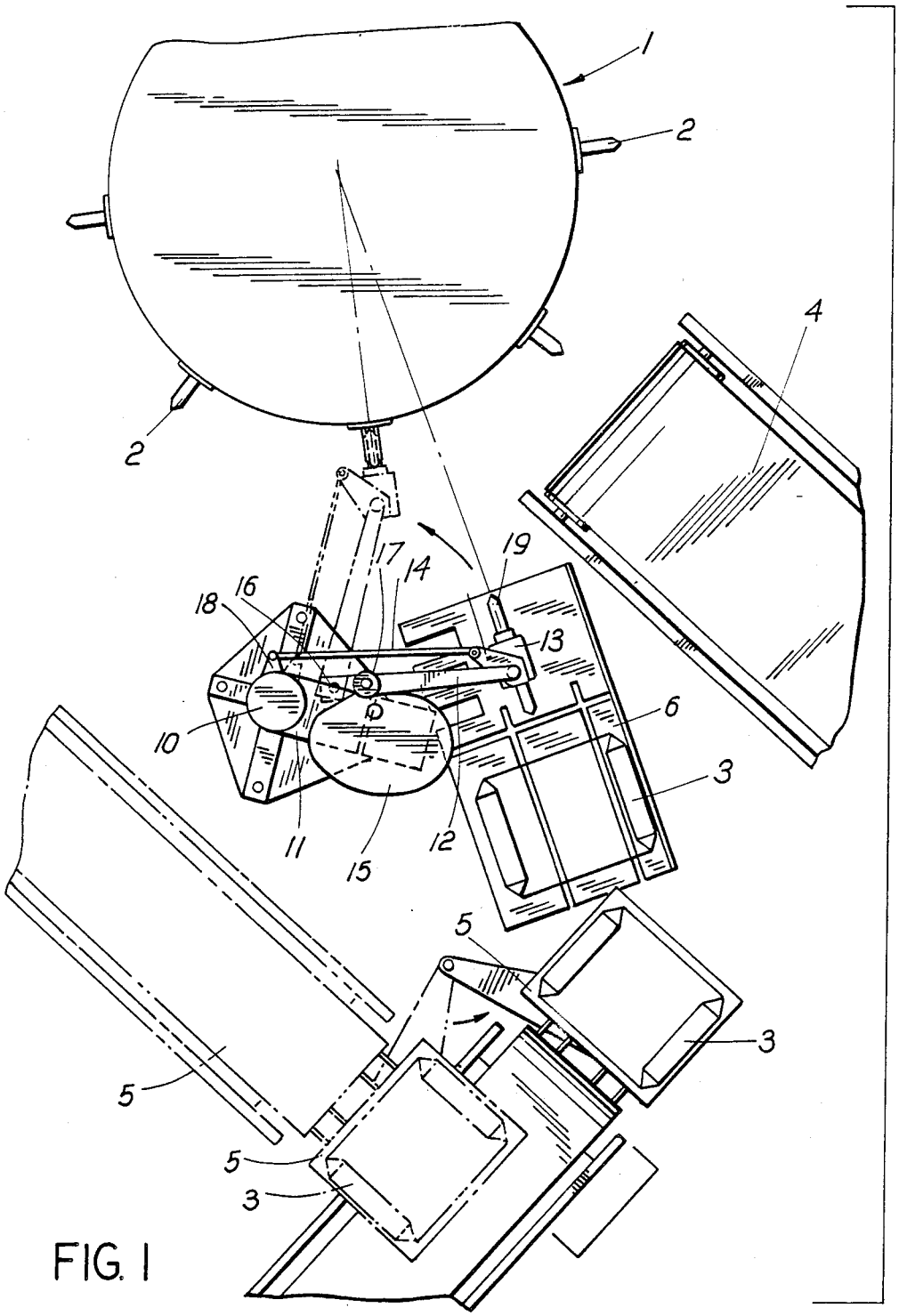

In the relevant field of the art, rotary bagging machines with multiple loading stations for granular, powdery or like materials are known, substantially consisting (as shown in FIG. 1) of a sort of cylindrical silo or disk 1 rotating on its base. Around said silo, at the lower part of the outer wall, a set of bagging stations 2 are applied, substantially consisting of a nozzle or bagging spout on which bags 3 are threaded, of the type provided with automatic closure valves, said nozzle being connected with a weighing apparatus and devices causing, once the desired weight is reached, delivery of material from the nozzle to be stopped and bag to be ejected, said bag being then removed with known means such as the conveyor belt 4.

Several types of loading plants are known and more particularly the apparatus disclosed in EP-B1-0 028 219 claiming an apparatus for threading automatically bags on rotary bagging machines, substantially comprising a carousel device with arms having at their ends pincers adapted to pick up and hold the bags at the side provided with the valve already arranged in the open position (bag threading pincers), said carousel device being caused to rotate by said bagging machine through the contact between the driving means and the means synchronizing the relative movements of bagging machine and carousel device (synchronizer), mounted on the bagging machine in such a way that, once the synchronizing speed is reached, the open bag valve is frontally threaded on the nozzle of the bagging machine as said bag threading pincers are sliding in a channel being part of the synchronizer mounted axially aligned with the nozzle on the bagging machine.

More particularly the general structure of said bag threading apparatus according to said patent, as shown again in FIG. 1, substantially consists of a device 5 for advancing and picking bags from a bundle, a bag positioning device for picking and moving the bag to the bag threading pincers 6, and the above mentioned carousel device for inserting the bags.

An improvement to said apparatus is also known, consisting in mounting the devices engaging the synchronizer and the bag threading pincers on two coaxially arranged separate carousel devices, instead of a single carousel device, both devices idly rotating on the supporting column, it being possible to connect or disconnect them with one another by means of a toothed clutch (as many as the arms) which can be acutated by known means.

The present invention relates to a novel type of bag inserting device to be incorporated in said automatic bag loading apparatus on rotary bagging machines.

The apparatus is substantially the same up to the bag positioning device for picking and moving the bag to the bag threading pincers, that is the element 1 to 6 of FIG. 1, and replaces the bag inserting device with other means.

The device according to the present invention may be mounted in the cited apparatus as a substitution for the bag inserting carousel device, and it operates according to a wholly differnt principle, with the advantage over the prior one of higher inserting speed and greater operation reliability.

The device according to the present invention substantially consists of a stationary vertical support frame on which a swinging pincer holding arm is mounted, adapted to carry out an angular movement between the bag positioning device and the nozzle of the rotary bagging machine which has to be fed at that moment, said swinging arm being driven for its angular movement by a cam acting on a roller arranged on said swinging arm, the cam being rotated on its shaft by a motor with reduction gear, the cam shaft and the machine shaft being rotated in a synchronous way by known means, such as frequency variations and the like.

Figure 2:
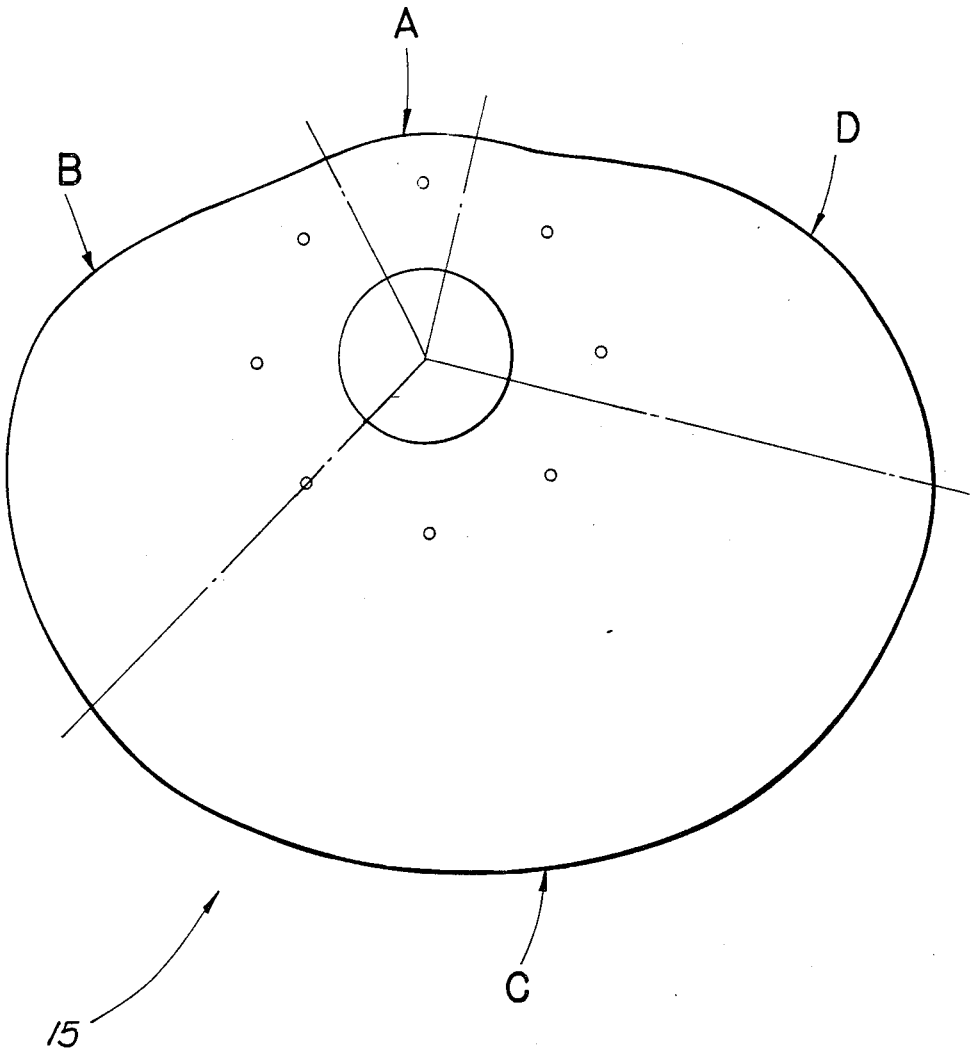

The present invention will be better understood with the detailed description of the embodiment given as a non limiting example illustrated in the accompanying sheets of drawings, in which:

FIG. 1 is a schematic plan view of a bag threading apparatus provided with the bag inserting device according to the invention; and FIG. 2 is a view of the contour of the cam actuating the device of the invention so as to show its features and operation.

With reference now to FIGS. 1 and 2 of drawings, the device according to the invention comprises a vertical frame such as a column 10, adapted to support the device at the desired height, which on a support 11 at its top bears a swinging arm 12 provided at its end with bag gripping pincers 13; a connecting rod 14 having the function of orienting the pincers between the bag gripping position and the postition inserting the bag on the nozzle; a cam 15 having a contour adapted to cause the swinging arm to carry out the various operations provided, namely, to grip the bag with the valve opened by the bag positioning device 6 and to thread said bag on the nozzle 2 of the rotary bagging machine 1, said cam 15 being rotated by a three-phase asynchronous motor with reduction unit, controlled through a device of known type, adapted to regulate the frequency of the motor supplying current, and therefore its speed in order to synchronize the angular speed of the motor and that of the rotary bagging machine.

The swinging arm is pivoted at 16 and has a roller 17 bearing against the cam 15, being held against it by known means such as a spring (not shown), fixed at one end to the arm 12 at the axis of the roller 17 and at the other end to an optimal point inside the cam, in order to avoid excessive size and stretch of said spring.

The connecting rod 14 is connected at one end with the support 18 fixed at the axis of the vertical frame 10 and at the other end with the crank 19 fixed to the pincers 13, and the group comprised of connecting rod 14 and crank 19 is designed so as to rotate said pincers between the bag picking position of the bag positioning device and the bag inserting position for such an angle that the pincers 13 are positioned axially aligned first with the side of the bag to be picked and then with the nozzle of the bagging machine.

By varying the length of the arm 12 and of the connected rod 14, it is possible to change the position of the bag inserting device in respect of the roary bagging machine and consequently the position of the bag feeding and positioning devices without altering the operation of the device, thus making easier the installation of the bag threading apparatus and allowing to match its arrangement with any bagging plant without needing any modification of the building structure.

The cam 15, as shown in FIG. 2, is of the eccentric type with the outer contour designed so as to cause, by acting on the arm driving roller 17, a well defined number of positions and functions of said arm according to its angular displacement.

With reference to FIG. 2, indeed when the roller 17 is in contact:

with the length A of the cam the "bag gripping phase" occurs, wherein the arm 12 is stationary and positioned above the bag to be picked, with open pincers which, after having received a control of known type at the closure device also of known type, clamps the bag holding its valve open;

with the length B of the cam the "nozzle approaching and synchronizing phase" occurs, wherein the arm moves towards the bagging machine, first undergoing an acceleration and then a deceleration, at the end of which its speed is synchronized with that of the bagging machine and the bag is in front of the nozzle of the rotary bagging machine;

with the length C of the cam the "bag inserting phase" occurs, wherein starting from the position of bag and nozzle aligned in synchronous movement, a relative movement is produced in the arm with respect to the nozzle along the axis joining nozzle and bag, and the bag is threaded on the nozzle, at the end of which the pincers, after having received a control of known type at the opening device also of known type, are opened and the bag remains threaded on the nozzle;

with the length D of the cam the "return phase" occurs, wherein the arm undergoes first an acceleration and then a deceleration until it stops with the pincers open in the starting position for picking another bag.

It was checked that the bag inserting device according to the present invention allows to feed the rotary bagging machines at a speed up to about 3200 bags per hour, which means almost the double of the quantity allowed by the hitherto available devices.

I claim:

1. Bag inserting device for automatic bag loading apparatus of rotary bagging machines having a nozzle (2) on a rotating disk, comprising a stationary vertical support frame (10), a swinging arm (12) mounted on said frame bearing pincers (13) at one end and a roller (17), said arm being pivotable between a bag positioning device (6) and said nozzle (2), a cam (15) for pivoting said arm acting on said roller (17), means for rotating the cam around its shaft by a motor with a reduction unit synchronously with the shaft of the rotating disk of the bagging machine, said cam (15) having a contour for producing sequentially in the swinging arm (12) a set of movements, said contour comprising: a length A for producing a back picking phase wherein the arm (12) is stationary and pincers close to clamp and hold the bag open; a length B for producing a nozzle approaching and synchronizing phase wherein the arm is moved toward the rotating disk, undergoing first an acceleration and then a deceleration at the end of which its speed is synchronized with that of the rotating disk and the bag is in front of the nozzle of the rotating disk; a length C for producing a bag inserting phase wherein, starting from the aligning position of bag and nozzle in synchronous movement, the arm is moved with respect to the nozzle along the axis joining nozzle and bag, so that the bag is threaded on the nozzle, at the end of which movement the pincers to the opening device also of known type, opens and the bag remains inserted on the nozzle; a length D for producing a return phase, wherein the arm undergoes first an acceleration and then a deceleration until it stops with the pincers open in the starting position, aligned with the bag positioning device for picking another bag.

2. Device according to claim 1, characterized in that the swinging arm (12) is associated with a connecting rod (14) and crank (19), pivoted on a support (18) fixed to the vertical frame (10) for rotating the pincers (13) so as to position them in the bag picking phase axially aligned with the bag (3) to be picked and then axially aligned with the nozzle (2) of the bagging machine.

3. Device according to claim 1, characterized in that, a spring is fixed at one side to the arm (12) at the roller (17) and at the other side to the optimal point inside the cam for holding the arm against the cam and for avoiding excessive size and stretch of said spring.

4. Device according to claim 1, characterized in that by varying the length of the arm (12) and of the connecting rod (14), it is possible to change the position of the bag inserting device in respect of the rotary bagging machine and consequently the position of the bag feeding and positioning devices without altering to operation of the device thus making easier the installation of the bag threading apparatus, allowing to match its arrangement to any bagging plant without needing modifications to the building structure.

* * * * *